United States Patent [19]

Cullen, Jr.

[11] Patent Number: 4,574,436

[45] Date of Patent: Mar. 11, 1986

[54] YARN TEXTURING JET

[75] Inventor: Robert E. Cullen, Jr., Kennett Square, Pa.

[73] Assignee: E. I. Du Pont de Nemours and Company, Wilmington, Del.

[21] Appl. No.: 728,518

[22] Filed: Apr. 29, 1985

Related U.S. Application Data

[63] Continuation-in-part of Ser. No. 668,441, Nov. 4, 1984, abandoned.

[51] Int. Cl.[4] ..... D02G 1/16; D02J 1/02

[52] U.S. Cl. ..... 28/254; 28/272; 28/273

[58] Field of Search ..... 28/254, 257, 273, 272

[56] References Cited

U.S. PATENT DOCUMENTS

| | | | |
|---|---|---|---|
| 4,041,583 | 8/1977 | Hart et al. | 28/254 |
| 4,104,770 | 8/1978 | Massey, Jr. et al. | 28/257 |
| 4,157,605 | 6/1979 | Agers | 28/273 X |
| 4,259,768 | 4/1981 | Uendening, Jr. et al. | 28/254 |
| 4,471,514 | 9/1984 | Stokes | 26/2 R |
| 4,492,009 | 1/1985 | Agers et al. | 28/254 |

FOREIGN PATENT DOCUMENTS

| | | | |
|---|---|---|---|
| 46-17294 | 5/1971 | Japan | 28/273 |

*Primary Examiner*—Robert R. Mackey

[57] ABSTRACT

In a self-stringing yarn texturing air jet which is compact and easy to string up includes a body, a yarn inlet section, a movable venturi and a yarn guiding element through which yarn passes to the outlet end of the jet, a second flange on the yarn guiding element located upstream of a flange with an orifice improves texturing efficiency of the jet.

3 Claims, 3 Drawing Figures

YARN TEXTURING JET

BACKGROUND OF THE INVENTION

This application is a continuation-in-part of copending application Ser. No. 668,441 filed Nov. 4, 1984, now abandoned. The invention relates to air texturing of yarn and more particularly, to improvements in a fluid jet apparatus used to texture the yarn.

U.S. patent application Ser. No. 668,440, of common assignee, now U.S. Pat. No. 4,547,938 granted Oct. 22, 1985, discloses a self-stringing jet device which is compact and easy to string up. The jet includes a body, a yarn inlet section, a movable venturi and a cylindrical yarn guiding element for guiding yarn from the inlet to the outlet end of the jet and a gas inlet. The outer diameter of the yarn guiding element is reduced in the region of the gas inlet to provide an annular plenum chamber following which is a cylindrical portion or flange with an outer diameter approximately equal to the inside diameter of the central bore through the body. The flange has an orifice through it for passage of gas through the jet. The forward portion of the yarn guiding element is a portion of reduced diameter which forms a chamber with the bore that is in communication with the outlet end of the jet. The venturi may be set to a string up position or to an operating position by means of a rotatable rod having a cam surface intermediate its ends engaging a groove in a collar on the venturi. An external handle is attached to one end of the rod and is movable between first and second stops representing string up and operating positions, respectively. The second stop preferably is a rotatable disc eccentrically mounted to the body of the jet and readily adjustable to provide a range of settings for the operating position.

SUMMARY OF THE INVENTION

It has now been found that improved yarn texturing efficiency can be obtained by adding a second flange on the yarn guiding element upstream of the flange with the orifice. In one embodiment, the second flange has the same diameter as the first flange and is located within the plenum of the jet body; in another embodiment, the second flange has a diameter less than the first flange and in both embodiments, the second flange serves to reduce the turbulence of the gas behind the first flange which in turn provides a more uniform flow of gas through the orifice in the first flange.

DETAILED DESCRIPTION OF THE PREFERRED EMBODIMENT

Figure 1:
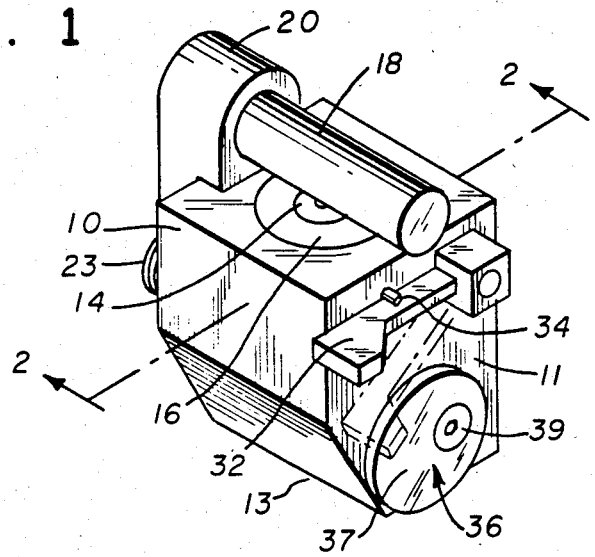
FIG. 1 is a perspective view of a preferred embodiment of the invention.
Figure 2:
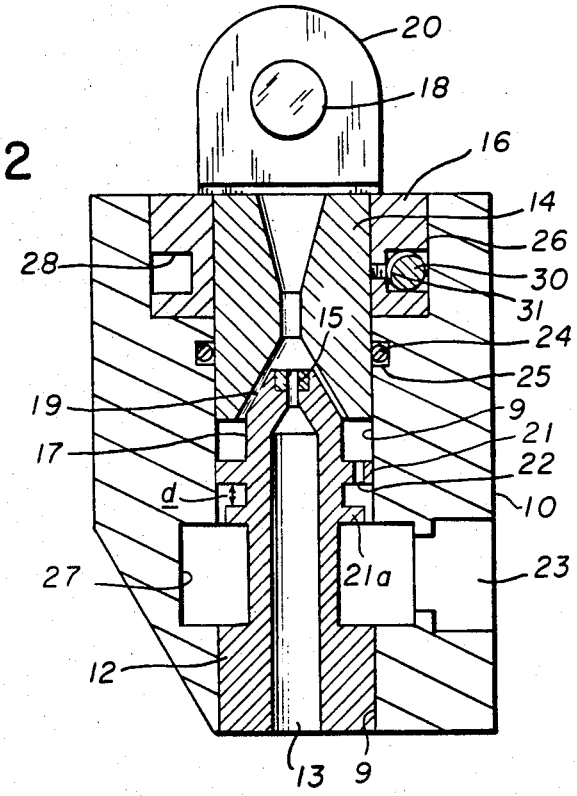
FIG. 2 is an enlarged section view of FIG. 1 taken along line 2—2.

Referring to FIGS. 1 and 2, the major elements of the jet device are body 10, cylindrical yarn guiding element 12, movable venturi 14 with its attached collar 16 and baffle 18 with its supporting bracket 20 attached to body 10. Yarn guiding element 12 is press fitted into the bore 9 of the body 10 at the inlet end of the jet body and consists of an entrance 13 in communication with the yarn exit orifice 15 of the yarn guiding element. The outer portion of the yarn guiding element comprises a cylindrical portion 17 with a conical tip 19. Orifice 22 located in a first flange 21 formed on yarn guiding element 12 has its axis parallel to the axis of yarn guiding element 12 and is supplied with gas such as compressed air through fluid connection 23. Coacting with orifice 22 is a plenum 27 which is circumferentially bored in the side walls of body 10 forming an enlargement of the bore at a location in communication with fluid connection 23. From FIG. 2, it will be noted that incoming air can rush into plenum chamber 27 and immediately pass toward venturi 14 through orifice 22. A second cylindrical flange 21*a* is formed on the yarn guiding element 12 a distance d upstream from the first flange 21 within the bore 9 of the jet body downstream of the gas inlet 23. The second flange 21*a* has a diameter that is less than the diameter of the first flange and preferably extends about one-half the distance beyond the yarn guiding element 12 as does the first flange. Venturi 14 is free to move axially within the body 10 and a seal is formed between the venturi and body by O-ring seal 24 seated in an annulus 25 in the body. The venturi 14 is press fitted into collar 16 and collar 16 is free to move within the recess 26 at the outlet end of the jet body. A circumferential groove 28 is formed in collar 16. A rod 30 extends through body 10 and engages groove 28. The rod is rotatable in both the body and the groove. A handle 32 is attached to the end of the rod so that the rod may be easily rotated. The rod is not completely circular but has a cam surface 31 intermediate its ends which is coincident with the groove 28. First and second stops 34, 36 respectively on the surface 11 of the body 10 restrict the movement of handle 32 and consequently the movement of venturi 14. The first stop 34 is a set screw extending above surface 11 of body 10 and the second stop 36 is a disc 37 eccentrically mounted to the surface 11 by a screw 39 which may be tightened to lock the disc in place.

Figure 3:
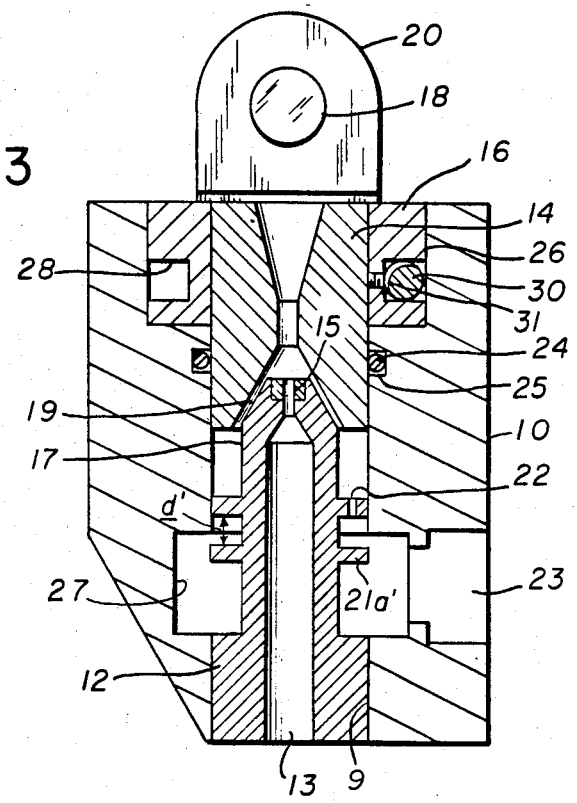
FIG. 3 is an enlarged section view similar to FIG. 2 of an alternate embodiment of the invention.

The embodiment shown in FIG. 3 is like that shown in FIGS. 1 and 2 except that the second flange 21*a*′ is a distance d′ upstream of the first flange and is now moved to a location within the plenum 27 and not within the bore 9. In this embodiment, the flange 21*a*′ is the same diameter as the flange 21.

The operation of this device is as follows: when a yarn or yarns are to be strung up, rod 30 is turned by handle 32 to a position shown in FIG. 1, (i.e., handle 32 is against stop 34) so that movable venturi 14 is moved toward conical tip 19 thus restricting the flow of air until ambient air is aspirated through yarn inlet 13 into and through movable venturi 14. The operator then inserts yarn into the inlet 13 where the aspirated air assists in carrying the yarn through the venturi to the outlet end. The operator then rotates rod 30 to the position shown in phantom in FIG. 1, (i.e., handle 32 is against disc 37) so that the movable venturi 14 is allowed to move away from conical tip 19 under the force of the air pressure within the jet until it reaches the optimum operating setting established by the orientation of disc 37.

In a series of test runs using the jet of this invention, it was found that increased texturing speed and longer jet operating periods between cleaning cycles were obtained.

I claim:

1. In a yarn texturing jet including a body having yarn inlet and outlet ends connected by a central bore, means for introducing pressurized gas through a gas inlet into said bore between said ends, a venturi located in said bore at said outlet end, and a yarn guiding element sealing off said bore at the yarn inlet end of the body, said element having a passage therethrough for guiding yarn from the yarn inlet of the body past the gas inlet through the exit end of said element to the venturi, said element having a first cylindrical flange thereon approximating the diameter of said bore, said first flange being located in the bore downstream from said gas inlet, there being an orifice in said first flange in communication with said gas inlet for directing pressurized gas from said gas inlet into said venturi, the improvement comprising: a second cylindrical flange fixed on said element a distance upstream from the first flange within said bore and downstream of the gas inlet, said second flange having a diameter less than the first flange.

2. The jet as defined in claim 1, said second flange extending about one-half the distance beyond the yarn guiding element as does the first flange.

3. In a yarn texturing jet including a body having yarn inlet and outlet ends connected by a central bore, means for introducing pressurized gas through a gas inlet into said bore through a plenum located between said ends, a venturi located in said bore at said outlet end, and a yarn guiding element sealing off said bore at the yarn inlet end of the body, said element having a passage therethrough for guiding yarn from the yarn inlet of the body past the gas inlet through the exit end of said element to the venturi, said element having a first cylindrical flange thereon approximating the diameter of said bore, said first flange being located in the bore downstream from said gas inlet, there being an orifice in said first flange in communication with said gas inlet for directing pressurized gas from said gas inlet into said venturi, the improvement comprising: a second cylindrical flange fixed on said element a distance upstream from the first flange within said plenum, said second flange having a diameter equal to the first flange.

* * * * *